US012747682B2

(12) United States Patent
Li et al.

(10) Patent No.: US 12,747,682 B2
(45) Date of Patent: Sep. 29, 2026

(54) VALVE LIFT CONVERSION CONTROL MECHANISM AND VALVE SYSTEM OF ENGINE

(71) Applicant: WEICHAI POWER CO., LTD., Weifang (CN)

(72) Inventors: Zhijie Li, Weifang (CN); Yibao Wang, Weifang (CN); Feng Yun, Weifang (CN); Fei Wang, Weifang (CN)

(73) Assignee: WEICHAI POWER CO., LTD., Weifang (CN)

( * ) Notice: Subject to any disclaimer, the term of this patent is extended or adjusted under 35 U.S.C. 154(b) by 115 days.

(21) Appl. No.: 18/865,859

(22) PCT Filed: Jul. 29, 2024

(86) PCT No.: PCT/CN2024/108082

§ 371 (c)(1),
(2) Date: Nov. 14, 2024

(87) PCT Pub. No.: WO2025/044641

PCT Pub. Date: Mar. 6, 2025

(65) Prior Publication Data

US 2026/0193997 A1 Jul. 9, 2026

(30) Foreign Application Priority Data

Aug. 25, 2023 (CN) ..... 202311077474.1

(51) Int. Cl.
*F01L 9/10* (2021.01)
*F01L 13/06* (2006.01)

(52) U.S. Cl.
CPC ..... *F01L 9/10* (2021.01); *F01L 13/06* (2013.01)

(58) Field of Classification Search
CPC ..... F01L 1/3442; F01L 1/2405; F01L 1/46; F01L 1/24; F01L 9/10; F01L 13/06; F01L 2001/34446
See application file for complete search history.

(56) References Cited

U.S. PATENT DOCUMENTS 5,445,116 A * 8/1995 Hara ..... F01L 1/267 123/90.43
5,452,694 A * 9/1995 Hara ..... F01L 1/267 123/90.16
9,217,339 B2 * 12/2015 McConville ..... F01L 13/0005
11,015,493 B2 * 5/2021 Cecur ..... F01L 1/2416
11,619,147 B2 * 4/2023 Mandell ..... F01L 1/181 123/90.16

(Continued)

*Primary Examiner* — Dapinder Singh
(74) *Attorney, Agent, or Firm* — CANTOR COLBURN LLP

(57) ABSTRACT

A valve lift conversion control mechanism includes a hydraulic transmission device that includes at least two device bodies, a check valve and a solenoid valve. The device bodies are in communication with each other through an oil circuit. The solenoid valve is configured to supply oil to the oil circuit through the check valve. The second device body is configured to be pressed downwards by a second rocker arm to be driven to press the oil in the oil circuit to increase an oil pressure, and a first device body is configured to press a first valve controlled by a first rocker arm downwards under the increased oil pressure in the oil circuit. The valve system of the engine includes the valve lift conversion control mechanism.

17 Claims, 9 Drawing Sheets

(56) References Cited

U.S. PATENT DOCUMENTS

| | | | | |
|---|---|---|---|---|
| 12,152,511 | B2 * | 11/2024 | Karlin | F01L 1/181 |
| 12,234,753 | B2 * | 2/2025 | Cecil | F01L 1/146 |
| 2004/0103868 | A1 * | 6/2004 | Engelberg | F01L 9/11 123/90.12 |
| 2014/0020654 | A1 * | 1/2014 | Yang | F01L 1/181 123/90.39 |
| 2017/0167319 | A1 * | 6/2017 | Kim | F01L 1/267 |
| 2017/0321575 | A1 * | 11/2017 | Wetzel | F01L 1/185 |
| 2017/0321576 | A1 * | 11/2017 | Nielsen | F01L 13/06 |
| 2021/0254515 | A1 * | 8/2021 | Ortiz-Soto | F01L 1/181 |
| 2021/0262368 | A1 * | 8/2021 | Wang | F01L 1/3442 |

* cited by examiner

VALVE LIFT CONVERSION CONTROL MECHANISM AND VALVE SYSTEM OF ENGINE

CROSS REFERENCE TO RELATED APPLICATIONS

This is the U.S. national stage of application No. PCT/CN2024/108082, filed on Jul. 29, 2024. Priority under 35 U.S.C. § 119 (a) and 35 U.S.C. § 365 (b) is claimed from Chinese Application No. 202311077474.1, filed on Aug. 25, 2023, titled "VALVE LIFT CONVERSION CONTROL MECHANISM AND VALVE SYSTEM OF ENGINE", the entire disclosures of which are incorporated herein by reference.

FIELD

The present application relates to the technical field of engine valve control, and in particular to a valve lift conversion control mechanism and a valve system of an engine.

BACKGROUND

A valve system of an engine includes a rocker arm, a valve and a cam shaft. A rocker arm shaft is provided at a middle portion of the rocker arm, and two ends of the rocker arm are respectively in contact with the valve and a cam of the cam shaft. During operation, the cam shaft rotates, and the cam drives the rocker arm to swing around the rocker arm shaft. The swinging rocker arm presses the valve to open the valve.

During operation of the engine, an additional variation in a valve lift is usually expected depending on actual operating conditions. For example, when the engine operates at low load conditions, an exhaust valve may open early, so that a high-temperature gas inside a cylinder can be discharged to heat an aftertreatment system before pushing a piston to produce work, thereby increasing the efficiency of the aftertreatment and reducing emission of contaminants. When an internal exhaust gas recirculation is adopted during operation of the engine, an additional small cam is needed on the cam shaft to control the exhaust valve to open again during the opening of an intake valve, to make the exhaust gas to flow back into the cylinder.

These additional variations in the valve lift are generally achieved by a switch mechanism. For example, when the valve lift of a first valve is expected to vary, a driving effect of a first drive that drives an entire normal lift of the first valve is removed first. Through the switch mechanism, a driving effect of a second drive is transmitted to the first valve, so that the first valve performs a lift provided by the second drive. However, the original normal lift provided to the first valve by the first drive has been removed, which thus cannot be combined with the lift provided to the first valve by the second drive.

Therefore, a problem to be solved by those skilled in the art is how to provide a valve lift conversion control mechanism to achieve the additional variations in the valve lift of the valve on the basis of the normal lift.

SUMMARY

A valve lift conversion control mechanism is provided according to the present application. A solenoid valve of the valve lift conversion control mechanism is configured to supply oil to an oil circuit of a hydraulic transmission device through a check valve. The oil in the oil circuit is pressed in a case that a second device body of the hydraulic transmission device is pressed downwards by a second rocker arm, and an oil pressure in the oil circuit is increased to drive a first device body to press a first valve controlled by a first rocker arm downwards. In this way, a valve lift controlled by the second rocker arm is transferred to the first valve controlled by the first rocker arm, thereby achieving conversion between valve lifts controlled by different rocker arms of a valve mechanism. Moreover, the valve lift conversion control mechanism may not affect swinging of the first rocker arm. Hence, a lift provided to the first valve by the first rocker arm and the lift provided to the first valve by the second rocker arm through the hydraulic transmission device can be combined, thereby achieving an additional variation in the lift of the first valve on the basis of the normal lift. A valve system of an engine employing the valve lift conversion control mechanism is further provided according to the present application, which enables an additional variation in the lift of the first valve on the basis of the normal lift.

In an embodiment, a valve lift conversion control mechanism applied to a valve system of an engine is provided, including a hydraulic transmission device, a check valve and a solenoid valve,

- the hydraulic transmission device includes at least two device bodies that are in communication with each other through an oil circuit;
- the solenoid valve is configured to supply oil to the oil circuit through the check valve; and
- the oil in the oil circuit is pressed to increase an oil pressure in a case that a second device body of the hydraulic transmission device is pressed downwards by a second rocker arm of the valve system, and a first device body of the hydraulic transmission device is configured to press a first valve controlled by a first rocker arm of the valve system downwards under the increased oil pressure in the oil circuit.

In an embodiment, the valve lift conversion control mechanism further includes a reset device for discharging the oil in the hydraulic transmission device.

In an embodiment, in the valve lift conversion control mechanism, each of the at least two device bodies includes a housing and a plunger inserted in the housing, and the plunger divides a space inside the housing into an elastic member mounting space and a hydraulic chamber;

- a hydraulic chamber of the first device body is in communication with a hydraulic chamber of the second device body through the oil circuit;
- a preload of an elastic member mounted inside an elastic member mounting space of the first device body is different from a preload of an elastic member mounted inside an elastic member mounting space of the second device body, and the preload of the elastic member mounted inside the elastic member mounting space of the first device body is relatively large;
- a first plunger of the first device body is configured to press the first valve controlled by the first rocker arm downwards under an action of the oil pressure in the hydraulic chamber of the first device body; and
- a second plunger of the second device body is configured to be pressed downwards by the second rocker arm to be driven to press the oil in the hydraulic chamber of the second device body.

In an embodiment, in the valve lift conversion control mechanism, the reset device includes a reset rod that is slidably inserted in a second housing of the second device body;

the second housing is provided with an oil discharge passage in communication with the hydraulic chamber of the second device body; and the reset rod is configured to open or close the oil discharge passage when moving.

In an embodiment, in the valve lift conversion control mechanism, the reset rod is connected to the second housing through a spring for providing a driving force to the reset rod in a direction away from the second housing to close the oil discharge passage; and the oil discharge passage is moved to open the reset rod in a case that the reset rod is pressed downwards by the second rocker arm.

In an embodiment, in the valve lift conversion control mechanism, an outer peripheral surface of the second plunger is provided with an annular groove, and the second plunger is provided with a passage in communication with the annular groove and the hydraulic chamber of the second device body;

the annular groove is in communication with the oil discharge passage all the time;

a diameter-reduced annular groove is provided at a periphery of the reset rod; and the oil discharge passage is opened in a case that the diameter-reduced annular groove and the oil discharge passage are aligned, and the oil discharge passage is closed in a case that the diameter-reduced annular groove and the oil discharge passage are staggered.

In an embodiment, in the valve lift conversion control mechanism, a size of the annular groove along a radial direction of the second plunger ranges from 0.05 mm to 2 mm.

In an embodiment, the valve lift conversion control mechanism further includes an oil storage valve in communication with an oil pipe between the solenoid valve and the check valve, and the oil storage valve is used for filling the oil circuit with the oil.

In an embodiment, a valve system of an engine is provided, including the first rocker arm which is swingable, the first cam being for driving the first rocker arm to swing, the first valve for being driven by the first rocker arm to open, a second rocker arm which is swingable, the second cam for driving the second rocker arm to swing, the second valve for being driven by the second rocker arm to open, and the valve lift conversion control mechanism according to any one of the above solutions.

In an embodiment, in the valve system, the second cam is configured to control the second valve through a clearance compensation mechanism by driving the second rocker arm to swing, and an outer peripheral surface of the second cam is provided with a small cam.

The valve lift conversion control mechanism applied to the valve system of the engine is provided according to the present application, including the hydraulic transmission device and the solenoid valve. The hydraulic transmission device includes the at least two device bodies that are in communication with each other through the oil circuit. The solenoid valve is configured to supply the oil to the oil circuit through the check valve. In the hydraulic transmission device, the second device body is configured to be pressed downwards by the second rocker arm of the valve system to be driven to press the oil in the oil circuit to increase the oil pressure, and the first device body is configured to press the first valve controlled by the first rocker arm of the valve system downwards under the increased oil pressure in the oil circuit.

In the above valve lift conversion control mechanism, the solenoid valve can supply the oil to the oil circuit of the hydraulic transmission device through the check valve, to make the hydraulic transmission device filled with the oil. The second device body of the hydraulic transmission device can be pressed downwards by the second rocker arm to be driven to press the oil in the oil circuit, to increase the oil pressure in the oil circuit to drive the first device body to press the first valve controlled by the first rocker arm downwards. In this way, the valve lift controlled by the second rocker arm is transmitted to the first valve controlled by the first rocker arm, thereby achieving conversion between the valve lifts controlled by different rocker arms of the valve mechanism. Moreover, the valve lift conversion control mechanism will not affect swinging of the first rocker arm. Hence, the lift provided to the first valve by the first rocker arm and the lift provided to the first valve by the second rocker arm through the hydraulic transmission device can be combined, thereby achieving the additional variation in the lift of the first valve on the basis of the normal lift.

Moreover, the valve lift conversion control mechanism will not affect the swinging of the second rocker arm, so that a normal lift of the second valve controlled by the second rocker arm can be achieved.

The valve system of the engine employing the valve lift conversion control mechanism is further provided according to the present application, which enables the additional variation in the lift of the first valve on the basis of the normal lift.

Figure 1:
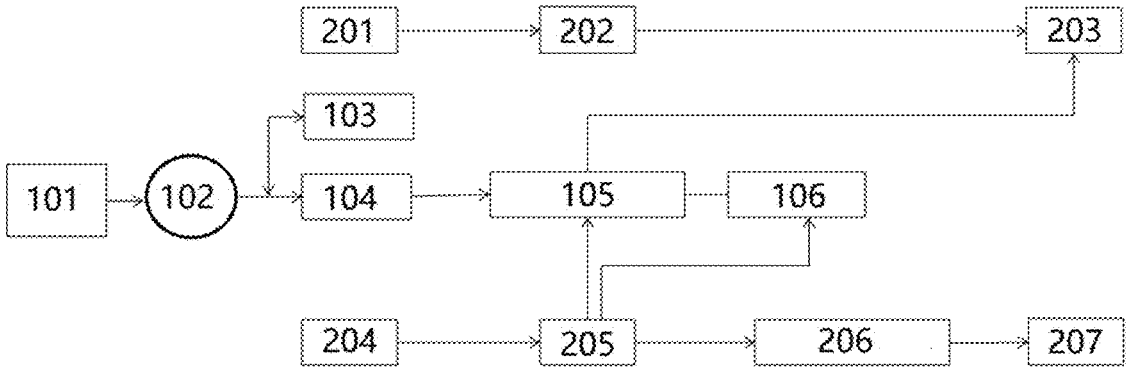
FIG. 1 is a diagram showing the control principle of a valve lift conversion control mechanism according to an embodiment of the present application.

Reference numerals:

| | | | |
|---|---|---|---|
| 101 | engine, | 102 | solenoid valve, |
| 103 | oil storage valve, | 104 | check valve, |
| 105 | hydraulic transmission device, | 151 | first spring, |
| 152 | first plunger, | 153 | first housing, |
| 154 | oil circuit, | 155 | second plunger, |
| 1551 | annular groove, | 1552 | passage, |
| 156 | second spring, | 157 | second housing, |
| 1571 | oil discharge passage, | 106 | reset device, |
| 161 | reset rod, | 1611 | diameter-reduced annular groove, |
| 162 | spring, | 201 | first cam, |
| 202 | first rocker arm, | 203 | first valve, |
| 204 | second cam, | 205 | second rocker arm, |
| 206 | clearance compensation mechanism, | | |
| 207 | second valve. | | |

DETAILED DESCRIPTION OF THE EMBODIMENTS

A valve lift conversion control mechanism is disclosed according to embodiments of the present application. A solenoid valve of the valve lift conversion control mechanism is configured to supply oil to an oil circuit of a hydraulic transmission device through a check valve. The oil in the oil circuit is pressed in a case that a second device body of the hydraulic transmission device is pressed downwards by a second rocker arm, such that an oil pressure in the oil circuit is increased to drive a first device body to press a first valve controlled by a first rocker arm downwards. Thus, a valve lift controlled by the second rocker arm is transferred to the first valve controlled by the first rocker arm, thereby achieving conversion between valve lifts controlled by different rocker arms of a valve mechanism. Moreover, the valve lift conversion control mechanism may not affect swinging of the first rocker arm. Hence, a lift provided to the first valve by the first rocker arm and the lift provided to the first valve by the second rocker arm through the hydraulic transmission device can be combined, thereby an additional variation can be added in the lift of the first valve on the basis of a normal lift. A valve system of an engine employing the valve lift conversion control mechanism is further disclosed according to the embodiments of the present application, which enables the additional variation in the lift of the first valve on the basis of the normal lift.

Referring to FIG. 1 to FIG. 13, a valve lift conversion control mechanism applied onto a valve system of an engine 101 is provided according to an embodiment of the present application, including a hydraulic transmission device 105 and a solenoid valve 102. The hydraulic transmission device 105 includes at least two device bodies that are in communication with each other through an oil circuit 154. The solenoid valve 102 is configured to supply oil to the oil circuit 154 through a check valve 104. In the hydraulic transmission device 105, the oil in the oil circuit 154 is pressed in a cased that the second device body is pressed downwards by a second rocker arm 205 of the valve system to increase an oil pressure, and a first device body is configured to press a first valve 203 controlled by a first rocker arm 202 of the valve system downwards under the increased oil pressure in the oil circuit 154.

In the above valve lift conversion control mechanism, the solenoid valve 102 can supply the oil to the oil circuit 154 of the hydraulic transmission device 105 through the check valve 104, so as to make the hydraulic transmission device 105 filled with the oil. The oil in the oil circuit 154 is pressed in a cased that the second device body of the hydraulic transmission device 105 is pressed downwards by the second rocker arm 205, such that the oil pressure in the oil circuit 154 is increased to drive the first device body to press the first valve 203 controlled by the first rocker arm 202 downwards. Thus, the valve lift controlled by the second rocker arm 205 is transferred to the first valve 203 controlled by the first rocker arm 202, thereby achieving a conversion between valve lifts controlled by different rocker arms of the valve mechanism. Moreover, the valve lift conversion control mechanism may not affect swinging of the first rocker arm 202. Hence, the lift provided to the first valve 203 by the first rocker arm 202 and the lift provided to the first valve 203 by the second rocker arm 205 through the hydraulic transmission device 105 can be combined, thereby the additional variation is added in the lift of the first valve 203 on the basis of the normal lift.

Moreover, the valve lift conversion control mechanism may not affect the swinging of the second rocker arm 205, so that a normal lift of the second valve 207 controlled by the second rocker arm 205 can be achieved.

In an embodiment, the valve lift conversion control mechanism further includes a reset device 106, and the reset device 106 is for discharging the oil in the hydraulic transmission device 105.

In the above solutions, each device body includes a housing and a plunger inserted in the housing, i.e. the first device body and the second device body each includes a housing and a plunger. The plunger divides a space inside the housing into an elastic member mounting space and a hydraulic chamber. The elastic member mounting space is for mounting of an elastic member. A hydraulic chamber of the first device body is in communication with a hydraulic chamber of the second device body through the oil circuit 154. A preload of an elastic member mounted inside an elastic member mounting space of the first device body is different from a preload of an elastic member mounted inside an elastic member mounting space of the second device body, and the preload of the elastic member mounted inside the elastic member mounting space of the first device body is relatively large. A plunger of the first device body is referred to as a first plunger 152, and is configured to press the first valve 203 controlled by the first rocker arm 202 downwards under an action of the oil pressure in the hydraulic chamber of the first device body. A plunger of the second device body is referred to as a second plunger 155, and the second plunger 155 of the second device body is configured to be pressed downwards by the second rocker arm 205 to be driven to press the oil in the hydraulic chamber of the second device body.

In an embodiment, an elastic member mounted inside the elastic member mounting space of the first device body is referred to as a first spring 151, and an elastic member mounted inside the elastic member mounting space of the second device body is referred to as a second spring 156.

The housing of the first device body is referred to as a first housing 153. Inside the first housing 153, the hydraulic chamber is located at an upper portion thereof, and the elastic member mounting space is located at a lower portion thereof. The housing of the second device body is referred to as a second housing 157. Inside the second housing 157, the hydraulic chamber is located at a lower portion thereof, and the elastic member mounting space is located at an upper portion thereof.

Figure 2:
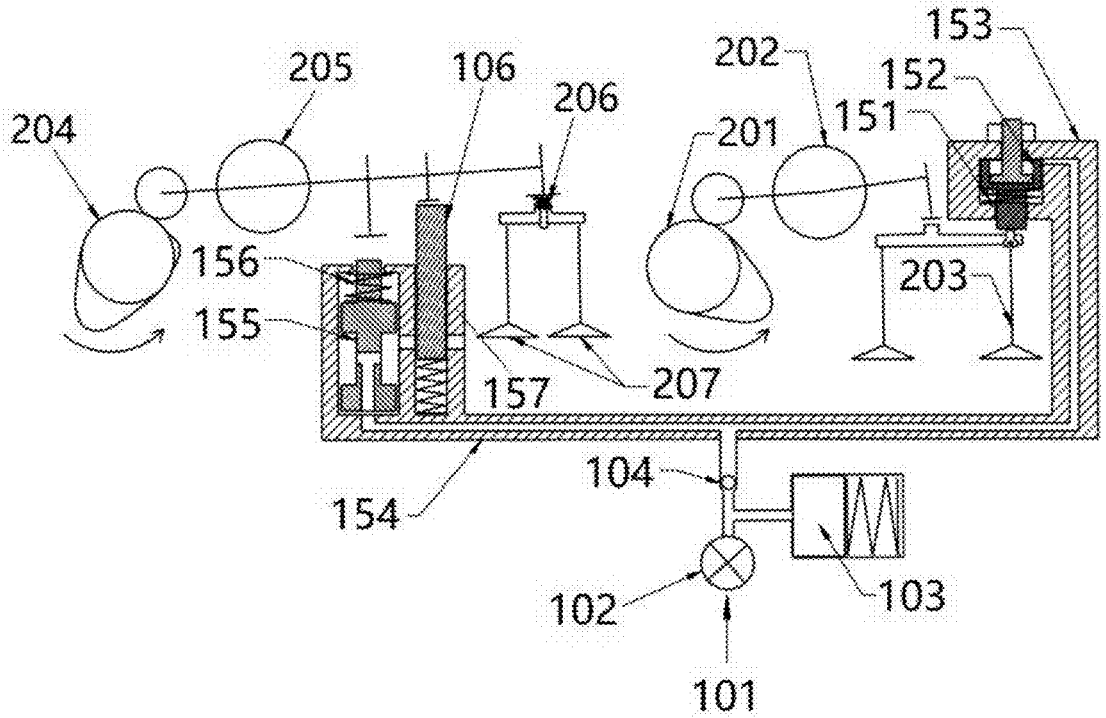
FIG. 2 is a schematic view showing the structure of the valve lift conversion control mechanism according to an embodiment of the present application.
Figure 3:
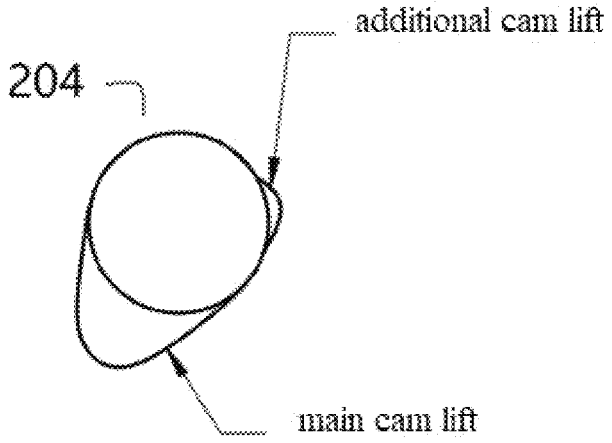
FIG. 3 is a schematic view showing the structure of a second cam according to an embodiment of the present application.
Figure 4:
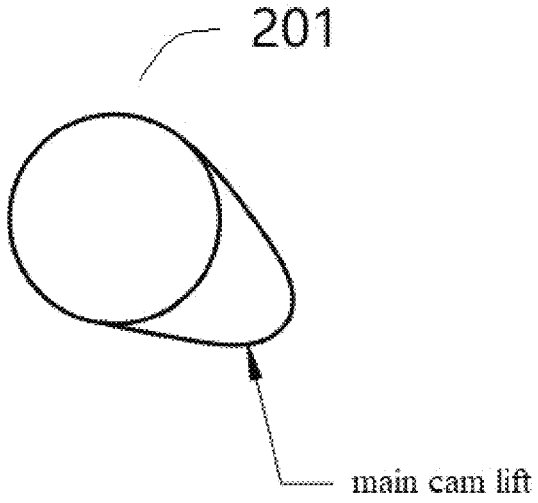
FIG. 4 is a schematic view showing the structure of a first cam according to an embodiment of the present application.
Figure 5:
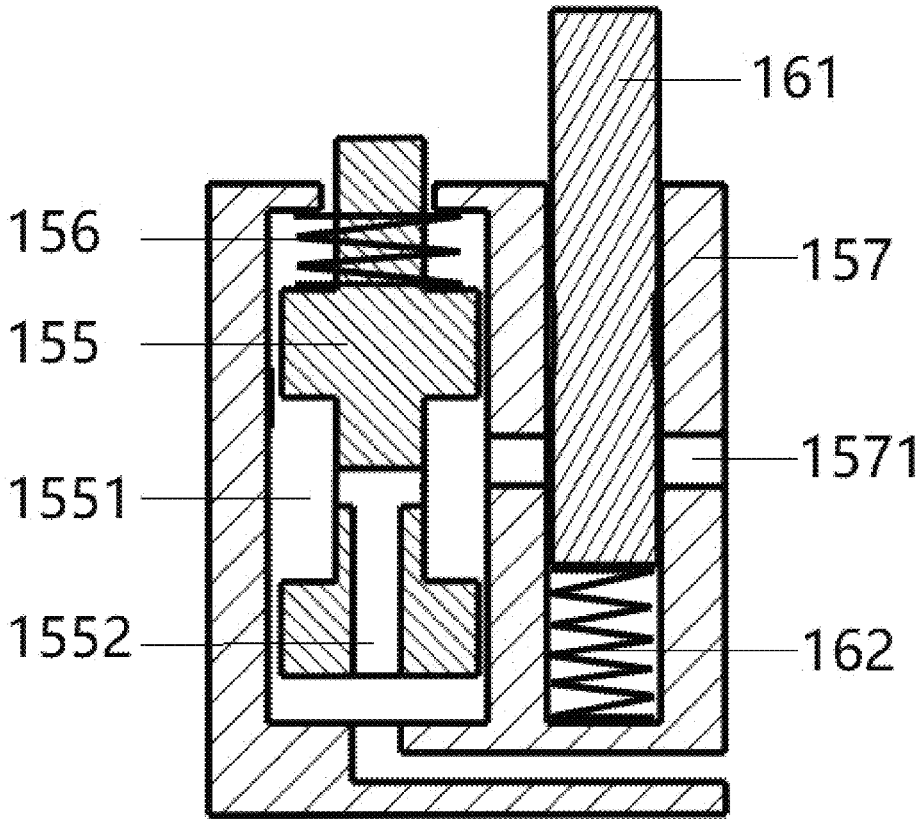
FIG. 5 is a schematic structural view showing that an annular groove of a reset rod and an oil discharge passage are staggered so that the oil discharge passage is closed according to an embodiment of the present application.
Figure 6:
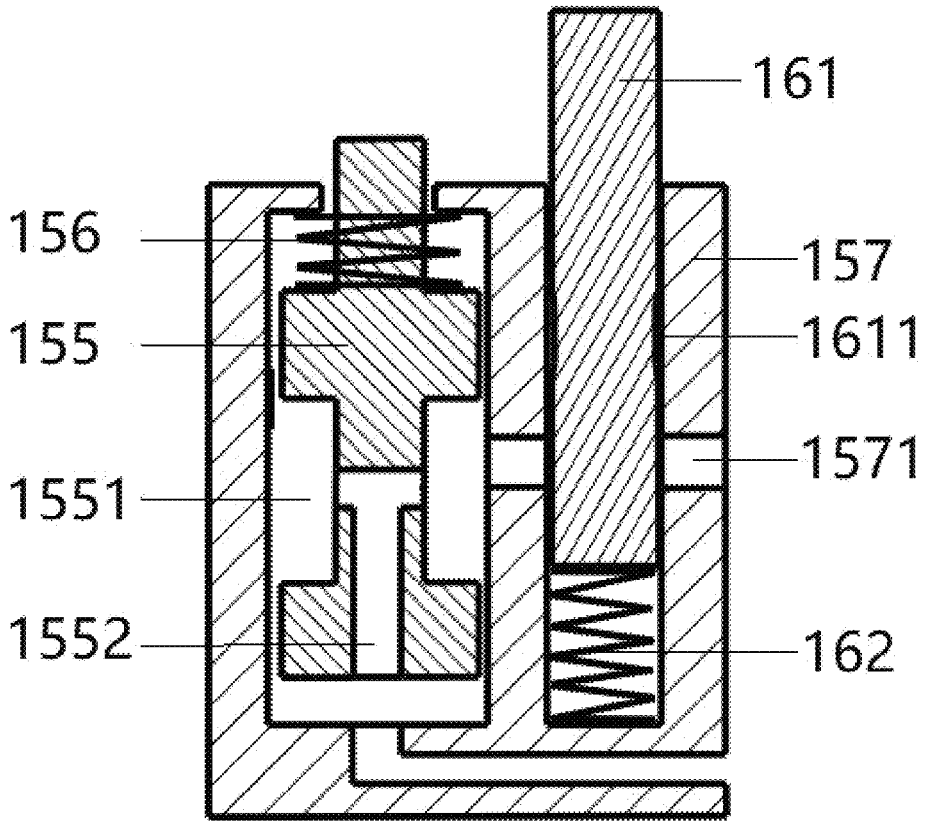
FIG. 6 is a schematic structural view showing that the annular groove of the reset rod and the oil discharge passage are aligned so that the oil discharge passage is opened according to an embodiment of the present application.

Referring to FIG. 2 and FIG. 5, the reset device 106 includes a reset rod 161 that is slidably inserted in the second housing 157 of the second device body. The second housing 157 is provided with an oil discharge passage 1571 in communication with the hydraulic chamber of the second device body. The reset rod 161 is configured to open or close the oil discharge passage 1571 when moving.

The reset rod 161 is connected to the second housing 157 through a spring 162, and the spring 162 is configured to provide a driving force to the reset rod 161 in a direction away from the second housing 157 to close the oil discharge passage 1571. The reset rod 161 can move to open the oil discharge passage 1571 in a case that it is pressed downwards by the second rocker arm 205.

An outer peripheral surface of the second plunger 155 is provided with an annular groove 1551, and the second plunger 155 is provided with a passage 1552 in communication with the annular groove 1551 and the hydraulic chamber of the second device body. The annular groove 1551 is in communication with the oil discharge passage 1571 all the time. A diameter-reduced annular groove 1611 is provided at a periphery of the reset rod 161. The oil discharge passage 1571 is opened in a case that the diameter-reduced annular groove 1611 and the oil discharge passage 1571 are aligned, and the oil discharge passage 1571 is closed in a case that the diameter-reduced annular groove 1611 and the oil discharge passage 1571 are staggered.

In an embodiment, a size of the annular groove 1551 along a radial direction of the second plunger 155 ranges from 0.05 mm to 2 mm.

The valve lift conversion control mechanism further includes an oil storage valve 103 in communication with an oil pipe between the solenoid valve 102 and the check valve 104, and the oil storage valve 103 is for filling the oil circuit 154 with the oil. The solenoid valve 102 is connected with the engine 101 for supplying the oil to the solenoid valve 102. An oil supply pressure of the engine 101 is higher than the preload of the elastic member mounted inside the elastic member mounting space of the second device body, and is lower than the preload of the elastic member mounted inside the elastic member mounting space of the first device body.

In the above valve lift conversion control mechanism, the first rocker arm 202 is driven by a first cam 201, and the second rocker arm 205 is driven by the second cam 204. The relationship between angle phases of a lift of the first cam 201 and a lift of the second cam 204 has been preset. The first cam 201 can drive the first rocker arm 202 to normally open and close the first valve 203. The second cam 204 can drive the second rocker arm 205 to control normal opening and closing of the second valve 207 through a clearance compensation mechanism 206. Furthermore, the second cam 204 includes an additional cam lift, which can be transferred to the first valve 203 through the hydraulic transmission device 105, thereby realizing the conversion function of the valve lift.

When the solenoid valve 102 is closed, the hydraulic transmission device 105 is not filled with oil, and thus the transmission and conversion of the valve lift may not be performed. When the solenoid valve 102 is open, the hydraulic transmission device 105 is filled with the oil. The preload of the first spring 151 is larger than a pushing force applied on the first plunger 152 by the oil supply pressure of the engine 101, and the preload of the second spring 156 is smaller than a pushing force applied on the second plunger 155 by the oil supply pressure of the engine 101. The check valve 104 is provided between the oil circuit 154 of the hydraulic transmission device 105 and the solenoid valve 102. Therefore, the oil pressure in the hydraulic transmission device 105 is high when the second plunger 155 is pressed downwards by the second rocker arm 205. The high oil pressure overcomes damping of the first spring 151 and pushes the first plunger 152 to move, making the first plunger 152 press the first valve 203 downwards to achieve the conversion of the lift. The oil storage valve 103 is provided between the solenoid valve 102 and the check valve 104, and is used for a quick oil supplement after the hydraulic transmission device 105 is reset.

During moving of the second plunger 155, the annular groove 1551 is in communication with the oil discharge passage 1571 all the time. The oil discharge passage 1571 is opened or closed through upward or downward movements of the reset rod 161 controlled by the second rocker arm 205 in cooperation with the spring 162. The reset rod 161 is provided with the diameter-reduced annular groove 1611. When the second rocker arm 205 drives the reset rod 161 to overcome damping of the spring 162 and move downwards, the diameter-reduced annular groove 1611 is in communication with the oil discharge passage 1571 to discharge the oil. When the driving force applied by the second rocker arm 205 gradually disappears, the spring 162 drives the reset rod 161 to move, making the diameter-reduced annular groove 1611 and the oil discharge passage 1571 staggered. Parts of the reset rod 161 with a large outer diameter except from the diameter-reduced annular groove 1611 exactly face the oil discharge passage 1571, so that the oil discharge passage 1571 is blocked, and the oil will not be discharged.

Figure 7:
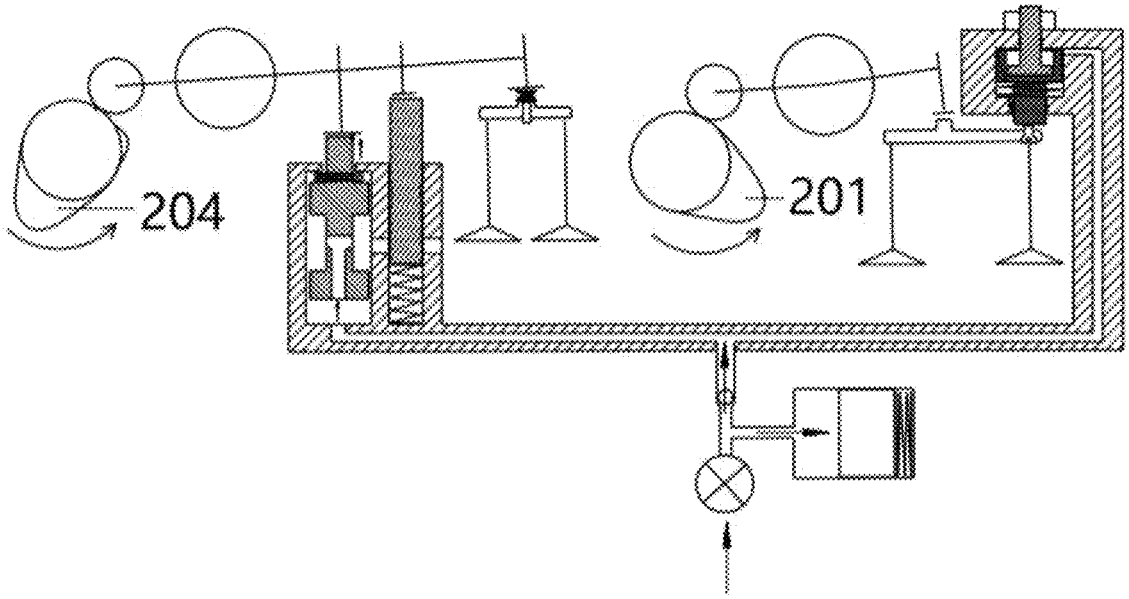
FIG. 7 is a schematic structural view showing that base circles of the first cam and the second cam of a valve system are respectively in contact with corresponding rocker arms, and a hydraulic transmission device is filled with oil according to an embodiment of the present application.

Referring to FIG. 7, the solenoid valve 102 is open, and the engine 101 starts. A base circle of the first cam 201 contacts the first rocker arm 202, and a base circle of the second cam 204 contacts the second rocker arm 205. At this time, the oil circuit 154 of the hydraulic transmission device 105 is filled with the oil, and the pushing force applied on the second plunger 155 by the oil pressure is larger than the preload of the second spring 156 to push the second plunger 155 upwards, so that a clearance between the second plunger 155 and the second rocker arm 205 is eliminated. The preload of the first spring 151 is larger than the pushing force applied on the first plunger 152 by the oil pressure, and therefore the first plunger 152 does not press the first valve 203 downwards under the pushing effect of the oil pressure.

Figure 8:
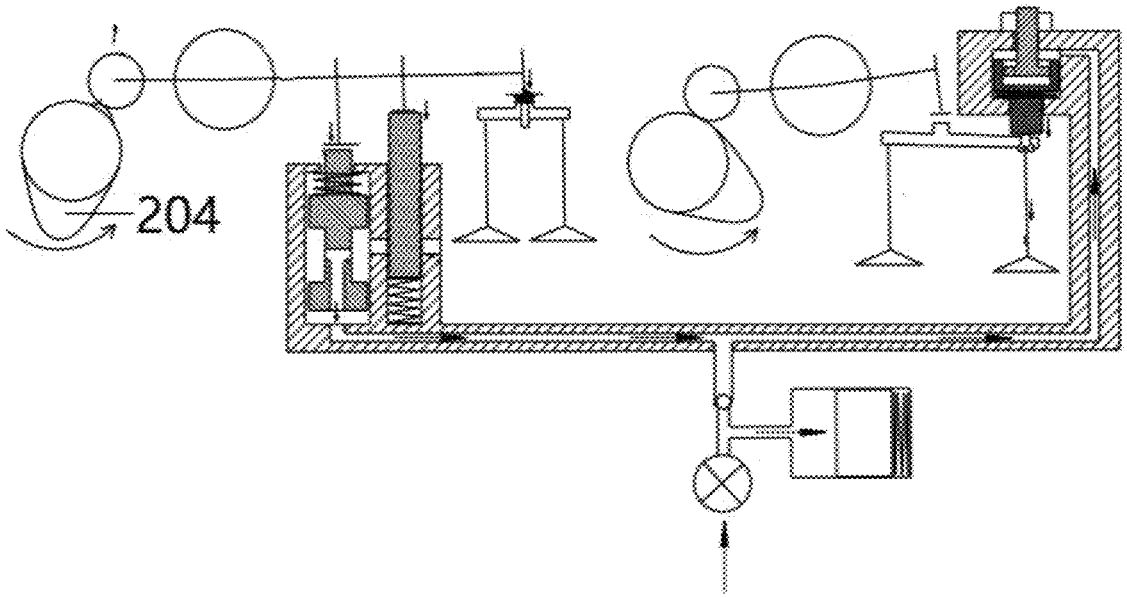
FIG. 8 is a schematic view showing the hydraulic status during a small cam lift of the second cam according to an embodiment of the present application.

As shown in FIG. 8, when the second cam 204 moves to a position in correspondence to the additional cam lift, the additional cam lift is compensated by the clearance compensation mechanism 206 between the second rocker arm 205 and the second valve 207, and thus the second valve 207 is not be opened. At the same time, since the clearance between the second plunger 155 and the second rocker arm 205 has been eliminated, the second plunger 155 is driven by the second rocker arm 205 to gradually move downwards, to gradually press the oil in the oil circuit 154 of the hydraulic transmission device 105. Blocked by the check valve 104, the oil pressure in the hydraulic transmission device 105 gradually increases until the oil pressure drives the first plunger 152 to overcome the preload of the first spring 151 to press downwards to open the first valve 203, thereby achieving the conversion of the lift from the second cam 204 to the first valve 203. With this conversion, the early exhaust valve opening function shown in FIG. 9 and other functions that require a variation in the valve lift can be realized.

Figure 9:
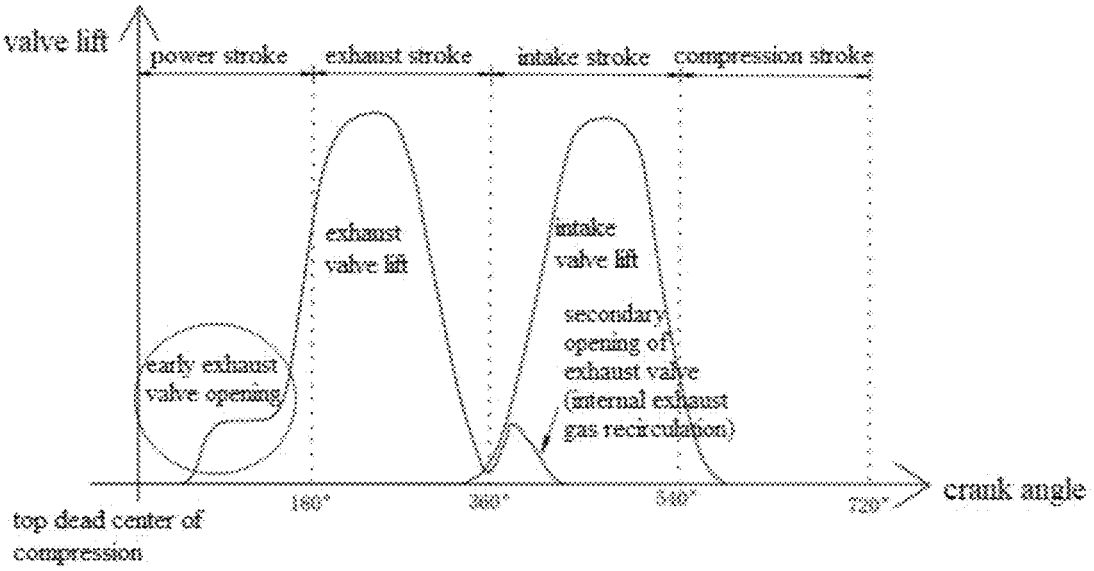
FIG. 9 is a graph showing the relationship between a valve phase and a valve lift of the valve system with early exhaust valve opening and internal exhaust gas recirculation according to an embodiment of the present application.
Figure 10:
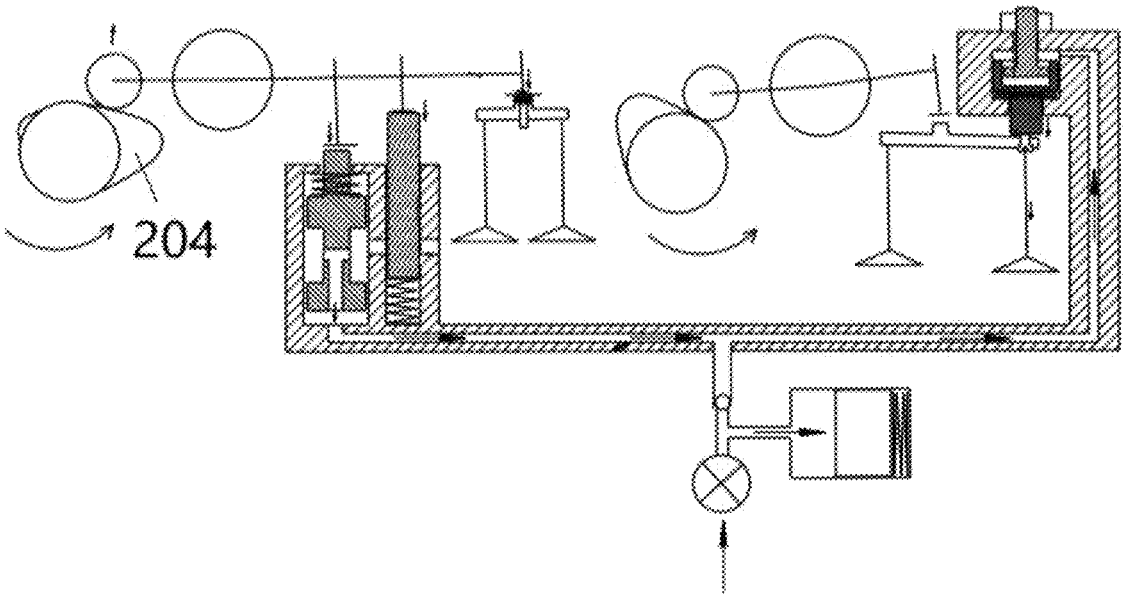
FIG. 10 is a schematic view showing the hydraulic status during a main cam lift of the second cam after the small cam lift according to an embodiment of the present application.

As shown in FIG. 10, the second cam 204 finishes the additional cam lift and continues to move to the main cam lift. In the beginning, the second cam 204 is still at a relatively low level of the main cam lift, basically the same as the additional cam lift. The second rocker arm 205 controls the second plunger 155 again to open the first valve 203 through the hydraulic conversion effect, thereby starting to perform a secondary opening function of the exhaust valve labeled in FIG. 9.

Figure 11:
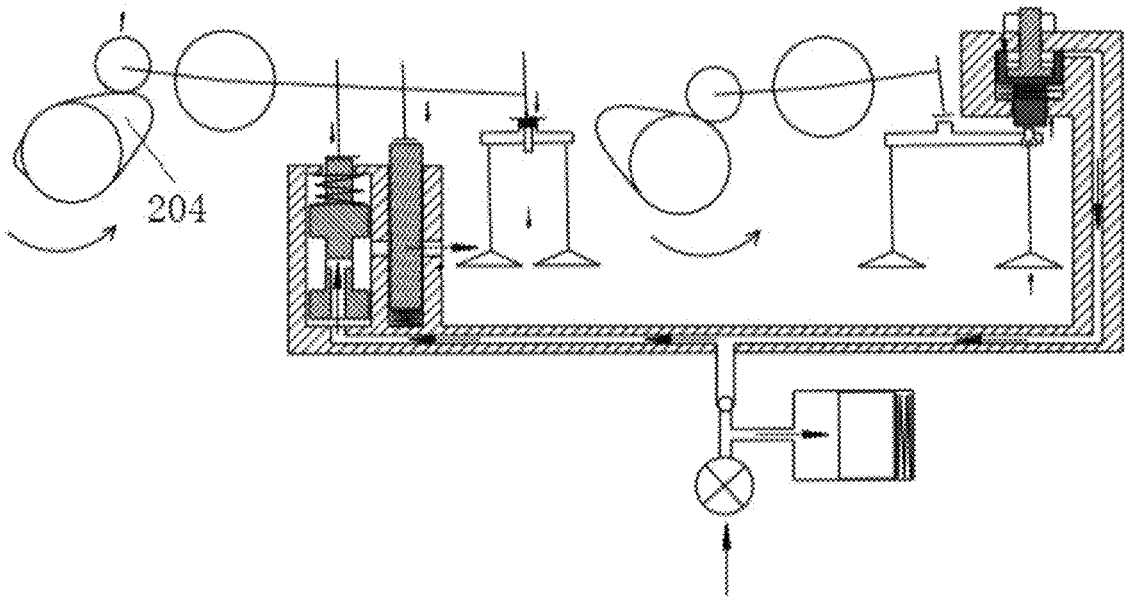
FIG. 11 is a schematic view showing that the second cam is in the main cam lift and the first valve is reset after the oil in the hydraulic transmission device is discharged according to an embodiment of the present application.

As shown in FIG. 11, after the main cam lift of the second cam 204 starts, the lift continues to increase, and the second rocker arm 205 continues to press the second plunger 155 and the reset rod 161 to move downwards. The diameter-reduced annular groove 1611 of the reset rod 161 and the oil discharge passage 1571 are aligned, and the hydraulic transmission device 105 discharges the oil. The first plunger 152 returns, and the first valve 203 returns and is closed following the first plunger 152. As such, the lift of the first valve 203 gradually falls back after the secondary opening, and finally the first valve 203 is closed, that is, the secondary opening function of the exhaust valve as shown in FIG. 9 is completely performed. Since the size of the diameter-reduced annular groove 1611 of the reset rod 161 along the radial direction ranges from 0.05 mm to 2 mm, the discharging speed of the oil during the oil discharging process can be controlled, so that a return speed of the first valve 203 is relatively low, thereby achieving buffered returning and closing. At this time, the second rocker arm 205 continues to press downwards, and the clearance compensation mechanism 206 is completely compensated. The second valve 207 is driven by the second rocker arm 205 to normally open.

Figure 12:
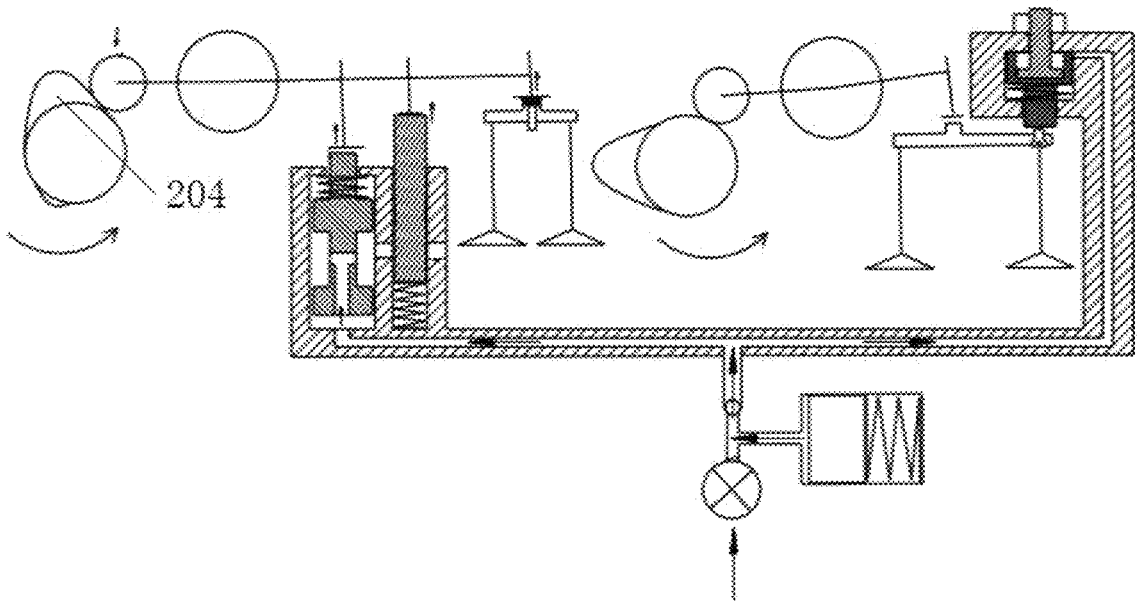
FIG. 12 is a schematic view showing that the second cam finishes the main cam lift, the second rocker arm returns, and the oil is supplied to the hydraulic transmission device according to an embodiment of the present application.

As shown in FIG. 12, when the second cam 204 finishes the main cam lift, and hence the second rocker arm 205 falls back, the oil pressure in the hydraulic transmission device 105 is decreased, and the reset rod 161 returns to a position where the oil discharge passage 1571 does not discharge the oil. The solenoid valve 102 opens and the oil is supplied to the hydraulic transmission device 105 through the check valve 104, and at the same time, the oil in the oil storage valve 103 is also pushed by an elastic member, such as a spring, inside the oil storage valve 103 to be quickly supplied to the hydraulic transmission device 105, so as to accelerate the oil supplement to prepare for the next circulation. The oil storage valve 103 is arranged between the solenoid valve 102 and the check valve 104, which may not change the volume of all the oil chambers of the hydraulic transmission device 105 after the check valve 104, and therefore may not affect the accuracy of the transmission of the lift.

Figure 13:
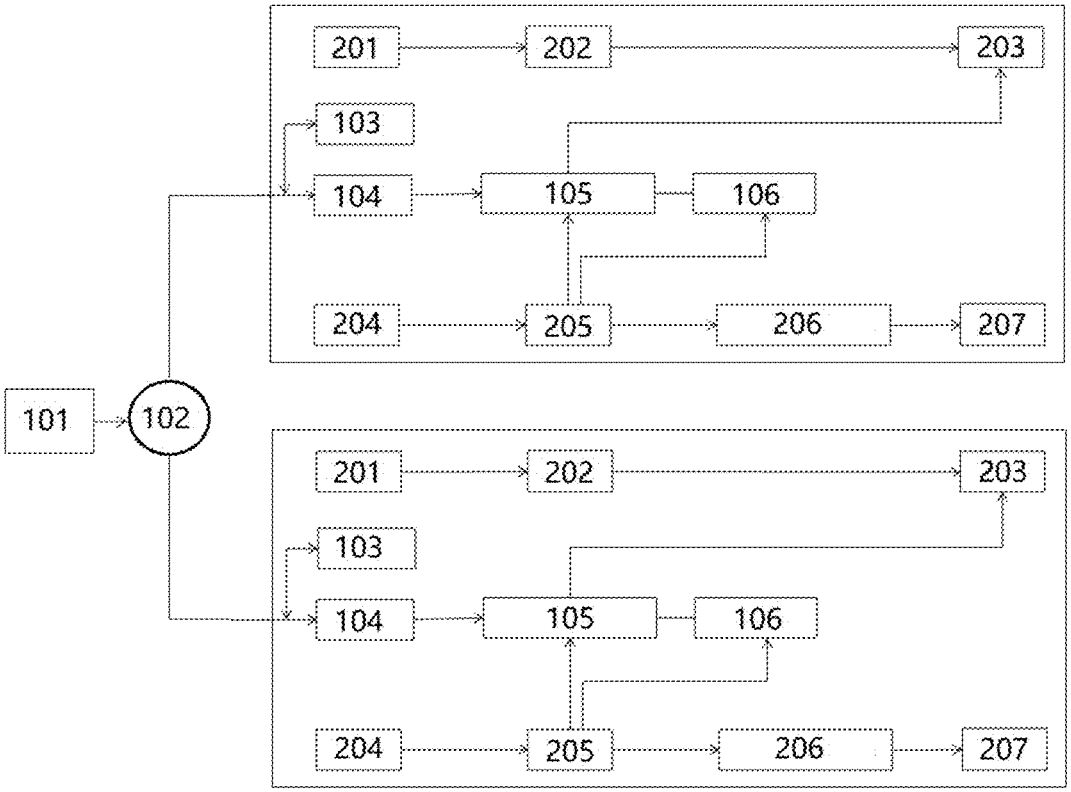
FIG. 13 is a schematic diagram showing two oil circuits controlled by a solenoid valve according to an embodiment of the present application.

In practice, two or more control oil circuits 154 may branch out from one single solenoid valve 102, so as to control two or more same hydraulic transmission devices 105 at the same time. That is, the lift conversions of two or more cylinders can be controlled by one single solenoid valve 102, as shown in FIG. 13.

A valve system of the engine 101 is further provided according to an embodiment of the present application, including the first rocker arm 202 being able to swing, the first cam 201 being configured to drive the first rocker arm 202 to swing, the first valve 203 for being driven by the first rocker arm 202 to open, the second rocker arm 205 which can swing, the second cam 204 for driving the second rocker arm 205 to swing, the second valve 207 for being driven by the second rocker arm 205 to open, and the valve lift conversion control mechanism according to the above embodiments.

The second cam 204 is configured to control the second valve 207 through the clearance compensation mechanism 206 by driving the second rocker arm 205 to swing. An outer peripheral surface of the second cam 204 is provided with a small cam for an additional cam lift.

The valve system of the engine 101 according to the present embodiment employs the above valve lift conversion control mechanism, so that an additional variation in the lift of the first valve 203 on the basis of the normal lift can be realized. Certainly, the valve system according to the present embodiment also has other effects of the valve lift conversion control mechanism according to the above embodiments, which are not described in detail herein.

The embodiments in this specification are described in a progressive manner. Each of the embodiments is mainly focused on describing its differences from other embodiments, and references may be made among these embodiments with respect to the same or similar portions among these embodiments.

The invention claimed is:

1. A valve lift conversion control mechanism applied to a valve system of an engine, comprising a hydraulic transmission device, a check valve and a solenoid valve, wherein the hydraulic transmission device comprises at least two device bodies that are in communication with each other through an oil circuit;

the solenoid valve is configured to supply oil to the oil circuit through the check valve; and the oil in the oil circuit is pressed in a case that a second device body of the hydraulic transmission device is pressed downwards by a second rocker arm of the valve system and an oil pressure is increased, and a first device body of the hydraulic transmission device presses a first valve controlled by a first rocker arm of the valve system downwards under the oil pressure in the oil circuit which is increased.

2. The valve lift conversion control mechanism according to claim 1, comprising a reset device for discharging the oil in the hydraulic transmission device.

3. The valve lift conversion control mechanism according to claim 2, wherein each of the at least two device bodies comprises a housing and a plunger inserted in the housing, and the plunger divides a space inside the housing into an elastic member mounting space and a hydraulic chamber;

a hydraulic chamber of the first device body is in communication with a hydraulic chamber of the second device body through the oil circuit;

a preload of an elastic member mounted inside an elastic member mounting space of the first device body is different from a preload of an elastic member mounted inside an elastic member mounting space of the second device body, and the preload of the elastic member mounted inside the elastic member mounting space of the first device body is relatively large;

a first plunger of the first device body is configured to press the first valve controlled by the first rocker arm downwards under an action of the oil pressure in the hydraulic chamber of the first device body; and a second plunger of the second device body is configured to be pressed downwards by the second rocker arm to be driven to press the oil in the hydraulic chamber of the second device body.

4. The valve lift conversion control mechanism according to claim 3, wherein the reset device comprises a reset rod that is slidably inserted in a second housing of the second device body;

the second housing is provided with an oil discharge passage in communication with the hydraulic chamber of the second device body; and the reset rod is configured to open or close the oil discharge passage when moving.

5. The valve lift conversion control mechanism according to claim 4, wherein the reset rod is connected to the second housing through a spring for providing a driving force to the reset rod in a direction away from the second housing to close the oil discharge passage; and the oil discharge passage is moved to open the reset rod in a case that the reset rod is pressed downwards by the second rocker arm.

6. The valve lift conversion control mechanism according to claim 5, wherein an outer peripheral surface of the second plunger is provided with an annular groove, and the second plunger is provided with a passage in communication with the annular groove and the hydraulic chamber of the second device body;

the annular groove is in communication with the oil discharge passage all the time;

a diameter-reduced annular groove is provided at a periphery of the reset rod; and the oil discharge passage is opened in a case that the diameter-reduced annular groove and the oil discharge passage are aligned, and the oil discharge passage is closed in a case that the diameter-reduced annular groove and the oil discharge passage are staggered.

7. The valve lift conversion control mechanism according to claim 6, wherein a size of the annular groove along a radial direction of the second plunger ranges from 0.05 mm to 2 mm.

8. The valve lift conversion control mechanism according to claim 1, comprising an oil storage valve in communication with an oil pipe between the solenoid valve and the check valve, wherein the oil storage valve is used for filling the oil circuit with the oil.

9. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 1.

10. The valve system according to claim 9, wherein the second cam is configured to control the second valve through a clearance compensation mechanism by driving the second rocker arm to swing, and an outer peripheral surface of the second cam is provided with a small cam.

11. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 2.

12. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 3.

13. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 4.

14. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 5.

15. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 6.

16. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 7.

17. A valve system of an engine, comprising the first rocker arm which is swingable, the first cam for driving the first rocker arm to swing, the first valve for being driven by the first rocker arm to open, the second rocker arm which is swingable, a second cam for driving the second rocker arm to swing, a second valve for being driven by the second rocker arm to open, and the valve lift conversion control mechanism according to claim 8.

* * * * *